United States Patent [19]

Small et al.

[11] Patent Number: 4,862,701

[45] Date of Patent: Sep. 5, 1989

[54] MOISTURE DETECTION

[75] Inventors: Michele Small, Mountain View; Kevin J. Friel, San Mateo; Paul A. Meager, Fremont, all of Calif.

[73] Assignee: NV Raychem SA, Kessel-lo, Belgium

[21] Appl. No.: 214,803

[22] Filed: Jun. 30, 1988

Related U.S. Application Data

[63] Continuation of Ser. No. 910,584, Sep. 23, 1986, abandoned.

[51] Int. Cl.[4] ..... F25D 21/02

[52] U.S. Cl. ..... 62/150; 200/61.04 62/275

[58] Field of Search ..... 62/150, 176.1, 275; 73/337, 73; 200/61.04, 61.05, 61.06; 137/78.3; 340/602

[56] References Cited

U.S. PATENT DOCUMENTS

| | | | |
|---|---|---|---|
| 2,088,718 | 8/1937 | Philipp | 200/61.06 |
| 2,432,367 | 12/1947 | Andresen | 200/61.04 |
| 3,204,872 | 9/1965 | Whear | 340/602 X |
| 3,443,395 | 5/1969 | Schweiger | 62/275 X |
| 4,182,357 | 1/1980 | Ornstein | 137/78.3 |
| 4,261,179 | 4/1981 | Dageford | 62/150 |
| 4,489,603 | 12/1984 | Fukami et al. . | |
| 4,655,076 | 4/1987 | Weihe et al. | 73/73 |

FOREIGN PATENT DOCUMENTS

| | | | |
|---|---|---|---|
| 1449824 | 7/1966 | France | 340/602 |
| 2227619 | 11/1974 | France | 200/61.04 |

*Primary Examiner*—Harry B. Tanner

*Attorney, Agent, or Firm*—Edith A. Rice; Herbert G. Burkard

[57] ABSTRACT

A fridge freezer is provided on a cold surface contactable by humid ambient air with a sensor that is able to activate a heater or an alarm etc., on the appearance of condensation.

6 Claims, 6 Drawing Sheets

MOISTURE DETECTION

This application is a continuation of application Ser. No. 910,584 filed Sept. 23, 1986 abandoned.

The present invention relates to the detection of moisture, by which we mean water in the liquid phase, that appears as condensation in refrigerators, air conditioning systems and other cooling devices.

It is often necessary that appearances of such condensation should be monitored, so that the condensation may be removed or that its recurrence be prevented in order that rusting, growth of bacteria or other damage be prevented. Unfortunately, it may not be possible without using complex controls to produce, say, a refrigerator where condensation is never a problem; the reason is simply that changes in ambient humidity and temperature will cause temperatures between different parts of the refrigerator and between the refrigerator and the atmosphere to vary, and if, for example, proper cooling is to be achieved during the winter, then condensation can be expected during a humid summer. Condensation may occur at various different places but it may be particularly troublesome in refrigerators that include a separate freezer, outside but attached to the refrigerator proper. Here there will be two areas of different temperature, and condensation may be expected on the vertical member (known as a mullion) between the two doors.

This problem is presently addressed in many refrigerators by the provision of some heating means for those parts on which condensation occurs. This heating means is to be switched on by the user under those conditions, generally high humidity, when the temperature of such parts is below the dew point of the ambient air, and thus when condensation is likely to occur. Unfortunately, the heater is often not used, in order presumably to save energy. This results in much condensation and the reason is not always perceived, it being thought instead that a fault has occurred. The refrigerator manufacturer is therefore called out, merely to throw a switch that the frugal owner has chosen to ignore.

We have now discovered that excellent operation can be maintained under widely varying ambient conditions by employing a moisture sensor (a device that detects liquid water, as opposed to the more common humidity sensor) positioned to receive condensate and coupled to a switch that activates a heater. We have found that an electrical switch of sufficient reliability and current carrying capacity can be operated by a water-expandable material requiring very small volumes of water, that response time is adequate and that expansion can be reversible.

Thus, the invention provides a cooling device (such as a refrigerator, which term as used here includes freezers, and air conditioning devices, etc.) having a moisture sensor comprising an electrical switch and a moisture-expandable material which on expansion operates the switch, the moisture expandable material being positioned to receive condensate.

We prefer that the moisture sensor be positioned either such that it receives condensate that runs or drips from a part of the cooling device to be protected, or such that condensation will form directly on the sensor under those conditions that will lead to (possibly after a further reduction in temperature or increase in humidity) to condensation on the parts of the device. Generally, the sensor should be positioned at a cold region , or in thermal contact with a cold region. Of particular interest is that region of fridge-freezers referred to as the mullion, namely that part between the two doors against which the two doors abut. A thin strip of the mullion, which will be cold because it is adjacent the freezer, will be accessible to the atmosphere between the two doors and will be susceptible to the formation of condensation.

The cooling device preferably also has a heater that is activated by the moisture sensor, either directly (the heater and the switch being in series in a circuit including a source of electrical power) or indirectly for example via a solenoid. Instead of such activation of a heater, the moisture sensor may activate some warning means such as a light or an audible alarm, that indicates that a heater is to be switched on or that operation of the cooling device should in some other way be modified.

Some form of collector for the condensate may be provided, to increase or decrease the catchment area and/or direct the water from the place where it forms to the moisture sensor. Such a collector may form part of the moisture sensor, which is then fixed to the cooling device, or it may comprise a part of the cooling device of suitable configuration.

In order that the moisture sensor be capable of continuous operation (rather than mere detection of the first instance of condensation) we prefer that on reduction of its water content the moisture-expandable material return towards (preferably substantially completely to) its initial size. It may dry out after the condensation that caused its wetting has been dealt with simply by natural evaporation, or drying may be encouraged by some heating means. Where the cooling device is in an atmosphere of high humidity or where a quick response of the sensor under changing conditions is required provision of such means may be preferred. If the moisture sensor is in thermal contact with the part of the cooling device whose function it is to protect, then a single heating means may serve to remove the condensate from both the part of the device and from the moisture expandable material. Thus, condensation causes expansion of the material, and activation of a heater that drives away the condensation and renders the moisture expandable material capable of detecting further condensate. Thus, the heater will automatically switch itself on and off with a frequency corresponding to the rate of formation of the condensate.

We also prefer that there be little or no hysteresis in the response of the moisture-expandable material to the quantity of water present. Thus, we prefer that the presence of a certain quantity of water produces a substantially immediate (by which we mean a delay of less than 8 minutes, especially less than 5 minutes particularly less than 3 minutes) expansion, and in some embodiments also that removal of water produces a sufficiently quick contraction (the same preferred delay times may apply), preferably to the same original dimensions.

The switch may be biased towards one state (for example open circuit) and be closed by expansion of the moisture expandable material, such that it automatically reopens as the material dries.

Instead of a simple on-off operation, the moisture sensor and heater may for some uses be capable of different degrees or rates of heating corresponding to different rates of condensation. For example, the output may be a function of the extent of expansion of the moisture-expandable material where a significant total expansion can be realized; one way of achieving this is to provide a heater comprising two or more heating elements of the same of different sizes that are sequentially brought into play with increasing extents of expansion. Similarly, more than one moisture sensing element may be provided, different elements perhaps responding to different volumes of water, and operating heating elements of different output. A further way of producing more control is for the total time or rate of drying out of the expandable material to be dependent on the amount of condensate. It may be desirable therefore that the total amount of water that can be received by the sensor be greater than the that required for sufficient expansion to operate the switch. In this way, the switch will remain on for a greater length of time. The rate of heating of the sensor to dry out the material may be varied by providing one or more heating elements whose output is a function of the extent of expansion, or otherwise related to the amount of condensate. Such control system may be desirable in order to avoid the sensor drying out but leaving the relevant part of the cooling device still wet, albeit insufficiently so for water to drip onto the sensor.

Whether or not this larger quantity of water be desired to delay switching off of the heater, it will generally be preferably that the smallest amount of water possible causes switching on: a certain amount of water will, in any case, have to condense on the cooling device before it will drip or otherwise flow onto the moisture-expandable material, and it is desirable that this be minimized.

There are two preferred ways in which this lag may be reduced. Firstly by careful choice of size, material, and positioning of the moisture sensor. If the sensor is small, particularly if the volume of moisture expandable material is small, it will respond to a small quantity of water. What is needed is a material that has a large percentage expansion since in general a small absolute size leads to a small absolute expansion. Cross-linked polyethylene oxide has been found to produce a sufficient extent and force of expansion using quantities of about 0.03 g. or less. Specific expandable materials will, however, be discussed in greater detail below. The situation may further be improved by positioning the sensor (or some form of moisture collector) in such a way that any moisture that forms immediately runs onto the expandable material without the need for a significant quantity to build up first. For example if the sensor is in contact with the part of the device subject to condensation, then water will flow immediately as it is formed rather than remain until droplets form. Preferably the sensor is positioned to receive condensation from a part of the surface of the device that is cooler than substantially any other part of the surface under normal operating conditions of the device. In this way substantially the first occurrence of condensation will be detected. The nature of the surfaces of the device and of the moisture sensor are preferably chosen such that they are not wet by water and such that water flows over them readily. Clearly it is desirable that the moisture sensor be positioned where moisture condenses first. It may be desirable to increase the volume of water that reaches the moisture-expandable material by provision of a collector to increase its catchment area, as mentioned above.

The second way in which the lag between condensation and detection may be reduced is to arrange for water to condense directly on the moisture sensor. The position, heat-capacity and other characteristics of the moisture sensor may be chosen such that condensation will appear on the sensor either before or at the same time as as (or even after) it appears on the device, as desired. Thus, condensation on the device itself may be entirely prevented, whilst condensation on the sensor may be in extremely small quantities and in any case may cause no harm.

Preferential condensation on the sensor may be achieved by ensuring that it remains slightly colder (for example 1° C.) than the part of the device that is to be protected. The part to be protected will in general comprise a surface exposed to the (moist) atmosphere, and the sensor may be arranged to be in thermal contact with something colder, for example the inside of the cooling device. The exposed surface will generally comprise some form of thermal insulation, and the sensor may be part of or fixed to (for example underneath) a probe etc. that extends through the thermal insulation. As the dew point of the ambient air falls (either through a fall in temperature or an increase in humidity) condensation will first occur on the sensor or probe. The switch will then be activated causing the heater to heat the exposed surface. Thus, the temperature of the exposed surface remains above the dew point of the ambient air, and no damaging condensation occurs on it.

Where there is likely to be a change in ambient temperature (but unlikely to be a change in humidity alone) the same effect may be achievable without maintaining the sensor at a lower temperature during steady state operation of the cooling device. In this case it may be possible to construct the sensor such that its surface temperature drops faster than that of the surface to be protected as the ambient temperature falls. That may arise from a lower thermal mass, higher thermal conductivity, or different surface characteristics. Thus, when ambient temperature falls, the sensor, which is cooled by the cooling device, will reach the dew point first, the heater will be switched on, and the surface in question will be kept above the dew point and thereby remain dry.

Any suitable moisture-expandable material may be used. The material is preferably chosen such that a displacement of at least 20 mils can be achieved from a quantity of water of 0.03 g or less. Since it is desirable that small quantities of water be detectable it will generally be necessary that the desired displacement be realized from a small amount of material, preferably 0.5 g. or less, especially 0.1 g. or less, particularly 0.02–0.05 g. The material preferably can expand by (i.e. increase one or more of its dimensions) by 1–6 times, and preferably is under 15 minutes, especially under 10 minutes, particularly under 5 minutes.

The way in which the material expands on wetting will depend on how the sample in use was fashioned. In general, the material may expand in all three dimensions, but expansion may occur principally or totally in one or two dimensions, which is clearly more efficient. This may be achieved in for example either of two ways. Firstly, the material may be fashioned by a technique such as extrusion that makes it inherently anisotropic as regards expansion, or a material for example a crystalline material may be chosen that is itself anisotropic. Secondly it may be restrained in one or two dimensions, for example by a part of the sensor, in order that expansion occur preferentially in a chosen direction. For example, the material may be placed in an open channel, the opening allowing entry of moisture, such that expansion is limited to the directions along the channel (which will in general cause activation of the switch) and expansion towards the opening. Depending on the rheological properties of the material, this may be expected to be more efficient, in the sense of producing greater useful linear expansion in the chosen direction, than if isotropic expansion were allowed. Expansion in the direction of the opening may be restricted or prevented by covering the opening with some means that allows passage of moisture in one direction but prevents passage of the expandable material in the other direction. Such means may comprise a mesh or other perforated cover. If this is done, and if some form of flow can occur within the material then the useful linear expansion may approach or equal the volume expansion of the unrestrained material.

Where the material chosen is soluble in water, it may be cross-linked, for example chemically or using irradiation, in the presence of prorads if desired. A beam dose of 5–20 Mrads, especially about 15 Mrads may be appropriate depending on the material, and assuming a prorad concentration of 1–5%.

If desired, the rate of swelling may be increased by increasing the rate at which water can interact with the material, and this may be done by increasing the surface area of the material available for contact with the water. If possible this should be done without increasing the volume available to the expanding material.

Some benefit may be realized by perforating the material, or employing it in particulate or foam form, if the perforations or interstices are sufficiently small, the benefit from the greater surface area will outweigh the disadvantage of provision of dead space into which the material can expand. Also, uptake of water into the bulk of the material maybe aided by capillary action thus adding to the benefit of increased surface area. The expandable material may be provided in a channel within the sensor, the channel having a surface to which the material does not adhere and having transverse dimensions slightly larger than that of the material. In this way, water that appears at an opening in the channel can spread (for example by capillary action) between the channel and the material preferably over substantially the entire periphery of the material.

The motion that the expandable material is able to generate may be increased by some form of external leverage, or by displacement of the material (or some other deformable material) from a region of greater cross-sectional size into a region of smaller cross-sectional size. In general the electrical switch that we prefer to use will require a movement of 20–40 mils. Extent of movement achieved in this way, will of course be at the expense of force.

The material may be provided simply as it is in a hole or channel within the sensor, or it may form part of a composite structure, for example a matrix impregnating a fabric, etc.

A preferred moisture expandable material comprises cross-linked polyethylene oxide, optionally together with one ore more other polymers or filler such as hydroxypropal methyl cellulose etc. A weight of 0.01–0.05, especially about 0.03 g. and a volume of about 0.03 $cm^3$ may be preferred. Such a material can generate a force of 0.2–0.3, particularly about 0.23 Kgf (½ lbf), is quick to respond and shows little hysteresis. Cross-linked polyethylene oxide is known from U.S. Pat. No. 3,957,605, but for the entirely different purpose of the production of disposable absorbent articles.

An alternative material comprises wood, particularly of the Redwood, Juniper, Cedar or Cypress trees. The bark of the Redwood tree, if cut radially with respect to the trunk, shows particularly high expansion.

A further material, disclosed in GB No. 1,538,669 comprises a cross-linked product of (a) a copolymer of a lower $C_2$–$C_6$ olefin and maleic anhydride, (b) a polymer emulsion having compatability with the polymer, and (c) a compound having at least two functional groups which are hydroxy groups, amino groups or epoxy groups. The component (b) may for example be an ethylene vinyl acetate copolymer emulsion, or an acrylic polymer emulsion. The component (c) may for example be ethylene glycol, propylene glycol, ethanolamine or ethylene diamine etc. The material may be shaped by extrusion, calendering, spreading or impregnating.

The invention is further illustrated by the accompanying drawings in which.

Figure 3A:
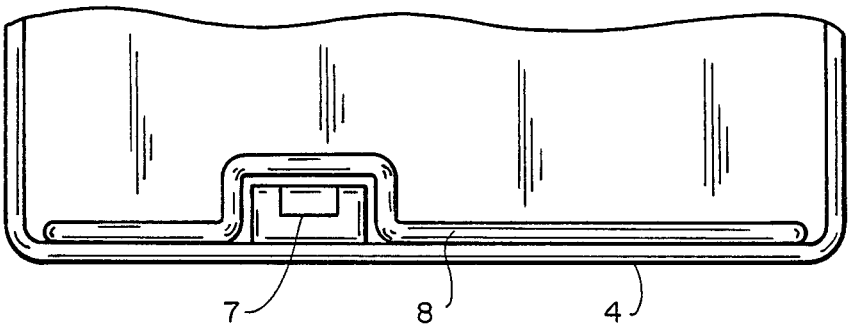
Figure 3B:
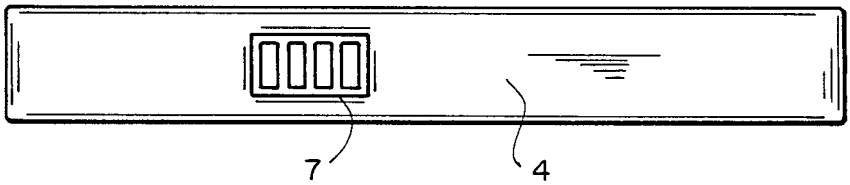
Figure 4A:
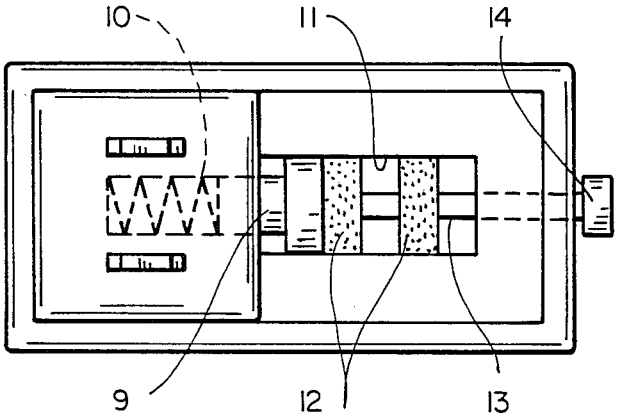
Figure 4B:
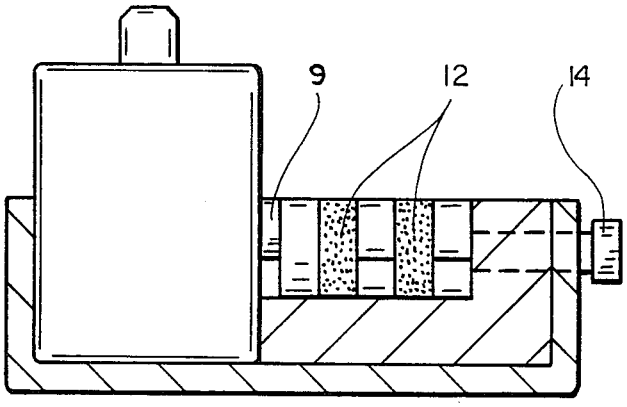
Figure 8:
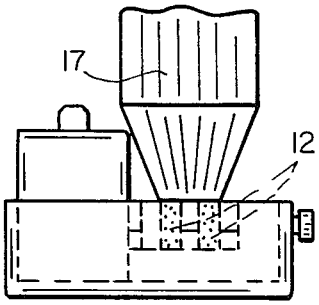
Figure 9A:
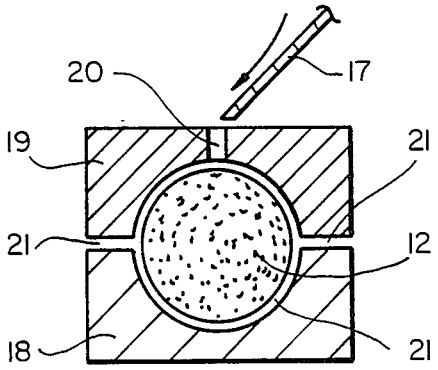
Figure 9B:
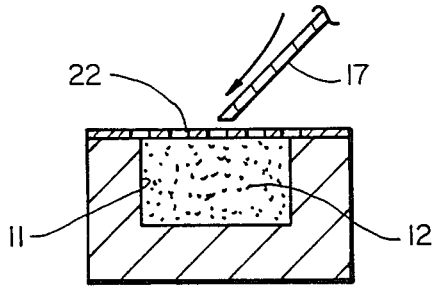
Figure 9C:
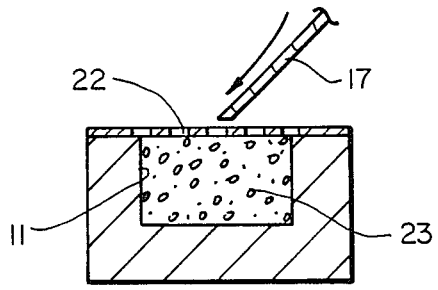
Figure 9D:
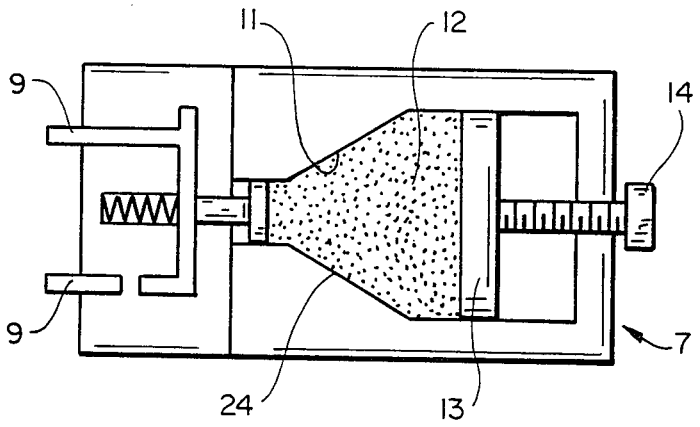
Figure 10:
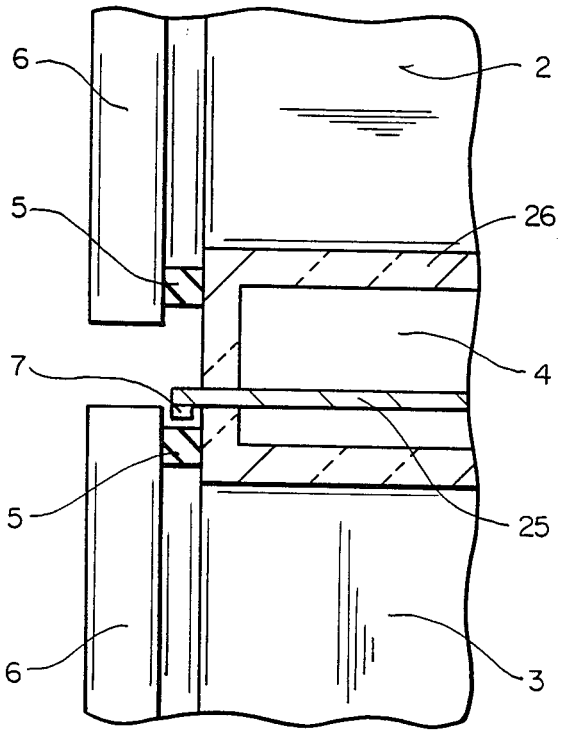

FIGS. 3*a* and 3*b* show positioning of a moisture sensor,

FIGS. 4*a* and 4*b* show a moisture sensor,

FIGS. 5*a*, 5*b*, 6 and 7 show heating circuits,

FIG. 8 shows a moisture sensor with a collector,

FIGS. 9*a*, 9*b*, 9*c*, and 9*d* show various ways of incorporating a moisture expandable material as part of the sensor, and FIG. 10 shows a sensor thermally coupled to a cold part of a fridge.

Figure 1:
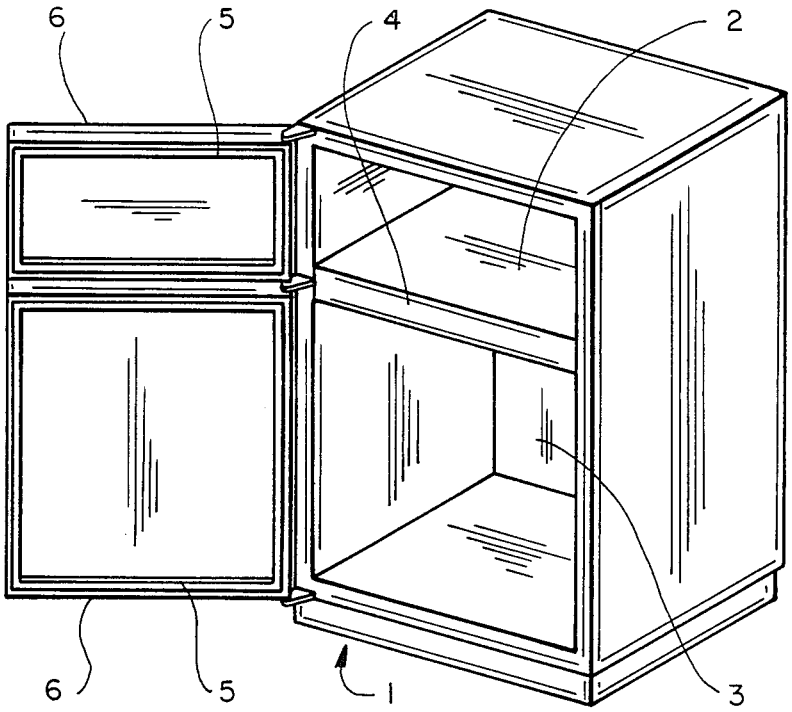
FIG. 1 shows a fridge-freezer.

FIG. 1 shows a fridge-freezer 1 having a freezer compartment 2 and a refrigerator compartment 3. The part 4 of the fridge-freezer between the two compartments is referred to as a mullion. Doors 6 are provided with gaskets 5 to make an air tight seal to compartments 2 and 3.

Figure 2:
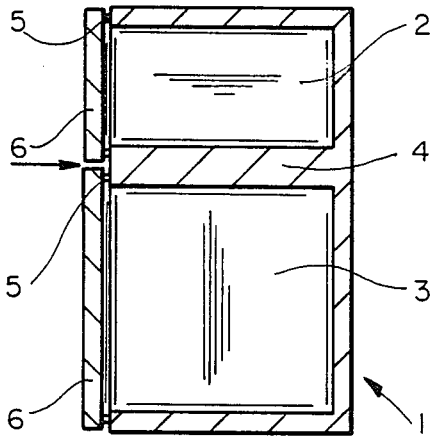
FIG. 2 is a cross-section of a fridge-freezer.

From FIG. 2 it can be seen that humid ambient air is able to contact the mullion 4 as indicated by the arrow. The mullion, however well insulated, will be cool, and moisture will condense on it, and become trapped in the lower gasket 5 or on the hinges by which the door is attached to the mullion. This may lead to rusting or growth of bacteria and mildew etc., which the present invention, seeks to prevent.

FIGS. 3*a* and 3*b* show the mullion 4 with a sensor 7 of the invention in place. The sensor activates a heater 8 on the appearance of water. The heater 8 raises the temperature of at least part of the mullion 4 to above the dew point of the ambient air.

A preferred design of sensor is illustrated in FIG. 4*a* in a plan view and in FIG. 4*b* in transverse cross-section. The sensor includes an electrical switch comprising contacts 9 held in by a spring 10 in an open position. A channel 11 is provided in the sensor for a moisture expandable material 12, which is restrained from expanding to the right as drawn by a block or plate 13 and adjustment screw 14. The block or plate 13 and screw 14 allow some variation in the size of the material 12, and allow for alteration of the extent of expansion necessary in the material 12 to cause the contacts 9 to be closed.

Figure 5A:
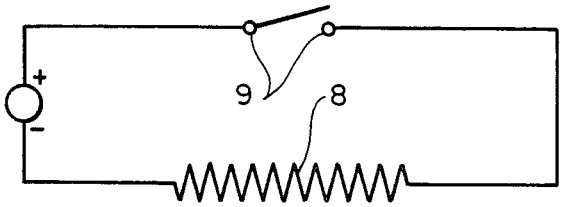
Figure 5B:
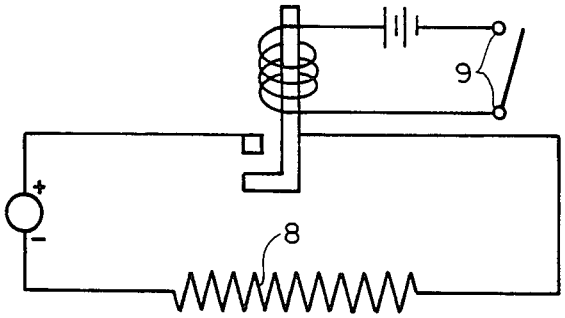
Figure 6:
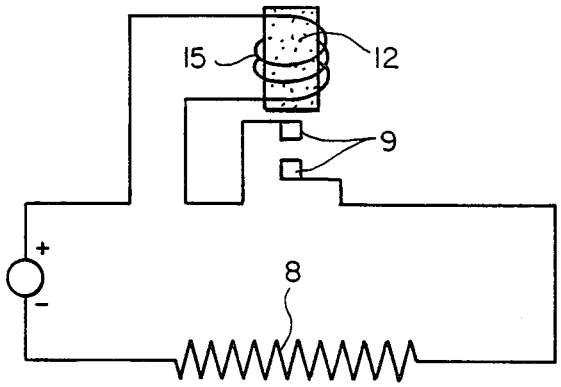
Figure 7:
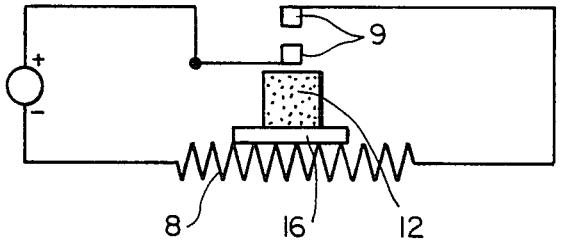

FIGS. 5–7 show various electrical circuits that may be used to activate a heater 8. In FIG. 5*a* a heater in thermal contact with a mullion is in series with the contacts 9 of the sensor and a voltage source.

The circuit in FIG. 5*b* is analogous except that a relay, controller by the sensor, is used to switch on the heating circuit which has a separate source of power.

In FIG. 6 the circuit has a second heater 14 which serves to dry out the moisture expandable material 12. Such a second heater 14 could be part of either circuit of FIG. 5*b*.

FIG. 7 shows a schematic thermal contact 16 between the heater 8 and the moisture expandable material 12, by means of which the material is dried out.

A moisture collector 17 is shown in FIG. 8 to direct water onto the moisture expandable material 12, and optionally to increase the catchment area.

FIGS. 9*a*–9*d* show various constructions of the sensor whereby the expandable material 12 is held. In FIG. 9*a* the sensor has a first part 18 and a second part 19 which are brought together around the material 12. The second part 19 has a hole 20 through which passes condensate, optionally via a collector 17 as indicated by the arrow. Expansion of the material 12 is substantially prevented in all directions in the plane of the paper as drawn, and is thus maximized in the single desired direction. Before expansion a slight gap 21 exists between the material 12 and the parts 18 and 19 into which the water creeps by capillary action thus improving the response time of the sensor.

In FIG. 9*b* expansion of the material out of the channel 11 is prevented or restricted by means of a mesh or other perforate member 22, through which however water is able to pass.

The moisture expandable material in FIG. 9*c* is in particulate form 23, allowing penetration of water into its bulk rapidly by capillary action.

FIG. 9*d* shows a channel 11 in a sensor 7 having a taper 24 towards the end where the contacts 9 are located. A given volume expansion of the material 12 will produce a magnified linear movement at the narrow end. The channel could have a step transition to a smaller size rather than a taper.

In FIG. 10 the mullion 4 is shown with a probe or other means 25 providing thermal contact between the sensor 7 and a cold part of the fridge-freezer. Since the external surface of the mullion 4 is covered with insulation 26, it will be at a higher temperature than the exposed end of the probe 25. Thus, the sensor 7 may be maintained at a lower temperature than the exposed surface of the mullion, and therefore, on increased humidity, condensation will form first on the probe 25 or sensor 7. The sensor is shown positioned underneath the probe 25 such that condensation on the probe drops or runs on the sensor. This need not be the case, and condensation may occur directly on some part of the sensor. When condensation has occurred on the sensor, a heater is switched on preventing the temperature of the exposed surface of the mullion 4 falling below the dew point of the ambient air.

We claim:

1. An assembly comprising:

(a) a cooling device;

(b) a cooled substrate associated with said cooling device and on which moisture may condense in the form of water;

(c) a moisture sensor comprising (i) a water expandable material positioned to receive said condensed water;

(ii) a collector that can direct condensate onto said material; and (iii) an electric switch which is operated by expansion of said material; and (d) heating means which activates on operation of said switch to heat said water expandable material.

2. An assembly according to claim 1, in which the sensor is positioned to receive condensate from a part of a surface of the cooling device contactable by ambient air, said part being cooler than substantially any other part of said surface under normal operating conditions of the device.

3. An assembly according to claim 1, wherein said heater also heats a part of a surface of the cooling device contactable by ambient air.

4. An assembly according to claim 1, in which the moisture-expandable material can expand by 1–6 times in under 5 minutes in one direction on contact with 0.03 g of water.

5. An assembly according to claim 1, in which the moisture-expandable material comprises a polymeric material.

6. An assembly according to claim 5, in which the polymeric material comprises cross-linked polyethylene oxide.

* * * * *